US005751667A

United States Patent [19]

Nunes

[11] Patent Number: 5,751,667

[45] Date of Patent: May 12, 1998

[54] CLOCK WITH OBJECT RECEIVING VOLUME

[76] Inventor: Brendon Nunes, 467 Westney Road S., Unit 3, Ajax, Ontario, Canada, L1S 6V7

[21] Appl. No.: 662,792

[22] Filed: Jun. 12, 1996

[51] Int. Cl.[6] ..... G04B 19/02

[52] U.S. Cl. ..... 368/223; 368/285; 368/294

[58] Field of Search ..... 368/10, 76, 80, 368/223, 228, 232, 276, 278, 285, 294, 296

[56] References Cited

U.S. PATENT DOCUMENTS

| | | | |
|---|---|---|---|
| D. 288,412 | 2/1987 | Nunes . | |
| D. 293,422 | 12/1987 | Nunes . | |
| D. 364,354 | 11/1995 | Nunes . | |
| 4,749,281 | 6/1988 | Nunes . | |
| 5,051,969 | 9/1991 | Huang | 368/223 |
| 5,077,709 | 12/1991 | Feher | 368/229 |

*Primary Examiner*—Vit W. Miska

*Attorney, Agent, or Firm*—Nixon & Vanderhye P.C.

[57] ABSTRACT

A measuring instrument assembly, such as a clock, thermometer, or barometer, comprises a casing including a base and an upstanding perimeter (e.g. annular) portion (e.g. integral with the base). An instrument face is mounted by the base and has an upper surface facing away from the base, typically including instrument indicia (such as clock numbers) and preferably also including word indicia. A substantially transparent cover substantially parallel to the instrument face and supported by the casing is spaced from the instrument face to define, with the casing upstanding perimeter portion, an interior volume. At least one discrete object, and preferably a plurality of loosely provided objects, such as golf tees, are disposed within the interior volume. A passageway is defined through the interior volume for an instrument shaft extending from the base substantially perpendicular to the face through the cover and spaced from the upstanding perimeter portion of the casing. A measuring instrument movement (e.g. a clock movement) is mounted by the base, and the movement shaft or shafts extend from the movement through the passageway.

12 Claims, 2 Drawing Sheets

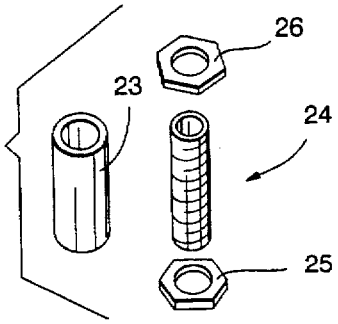
FIG. 3
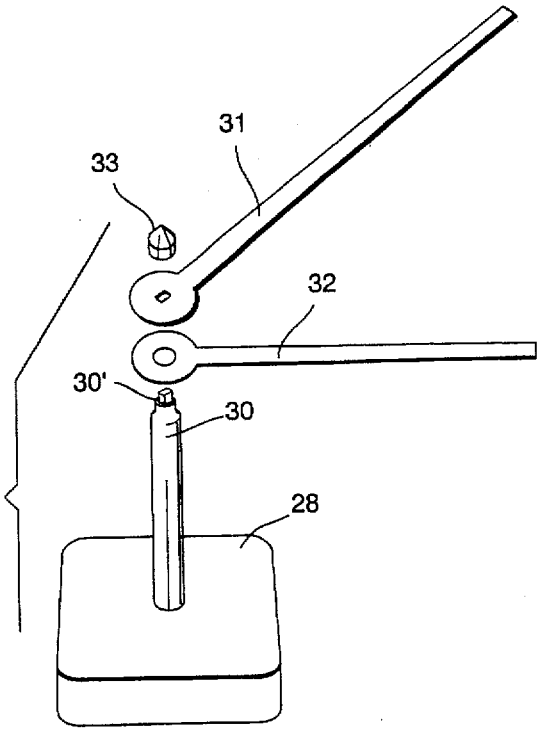
FIG. 4
FIG. 5
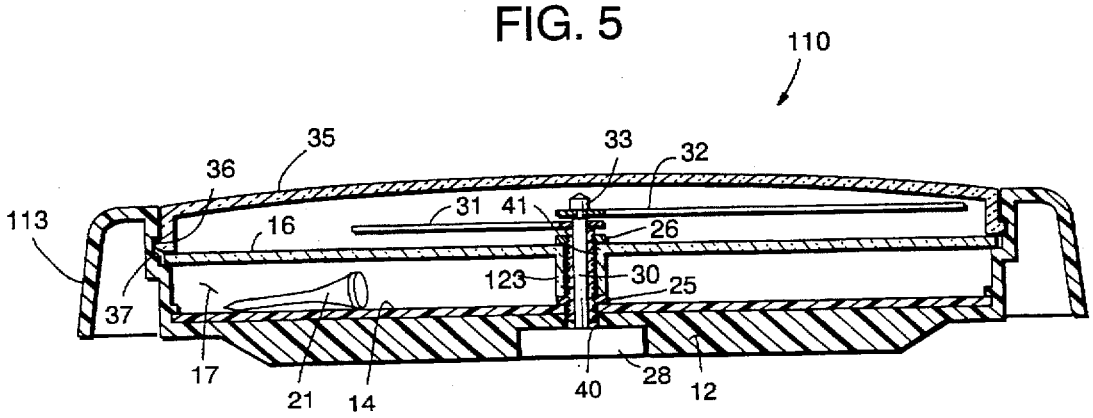

CLOCK WITH OBJECT RECEIVING VOLUME

BACKGROUND AND SUMMARY OF THE INVENTION

There are many individuals who wish to utilize instruments, such as clocks, thermometers, barometers, anemometers, or the like, that are also decorations, or statements about the personality or interests of the user. This has resulted in the production of a large number of novelty instruments, such as novelty clocks, having various shapes, configurations, and indicia, such as shown in U.S. Design Pat. Nos. 364,354, 293,422 and 288,412. The aesthetics or "statement"provided by such instruments have in the past, however, been essentially limited to changes in casing shape, and indicia. However according to the present invention a measuring instrument assembly is provided which goes further and in addition to allowing variation in casing configuration and indicia also allows the utilization of discrete objects associated with the measuring instrument which can provide an extremely distinctive look and function.

According to the present invention a measuring instrument assembly, such as a clock, is provided which includes an interior volume that is visible when normally viewing the measuring instrument, and which contains at least one (and preferably a plurality of) discrete objects which do not adversely affect the measuring instrument operation. For example the discrete objects may comprise golf tees, miniature athletic balls or other athletic equipment, puzzle pieces, individual elements containing photographs or portions of photographs, miniature bottles or simulations of bottles, or virtually any other object that might have an aesthetic or "statement"relationship to the user or expected viewers of the instrument.

According to the present invention a measuring instrument assembly is provided comprising the following components: A casing including a base and an upstanding perimeter portion. An instrument face mounted by the base and having an upper surface facing away from the base. A substantially transparent cover substantially parallel to the instrument face and supported by the casing, the cover spaced from the face to define, with the casing upstanding perimeter portion, a substantially closed interior volume [closed with respect to objects therein]. At least one discrete object disposed within the interior volume. And, means defining a passageway through the interior volume for an instrument shaft extending from the base substantially perpendicular to the face, through the cover, and spaced from the upstanding perimeter portion of the casing.

The measuring instrument assembly also further comprises a measuring instrument movement mounted by the base, at least one instrument shaft extending from the instrument movement through the passageway, and at least one instrument hand connected to the shaft(s) on the opposite side of the cover from the face. The discrete objects do not adversely affect the measuring instrument movement, and because the hand is on the opposite side of the cover from the objects do not interfere with the hand movement. The instrument movement may comprise almost any conventional instrument movement, such as a clock movement, thermometer movement (e.g. such as in U.S. Pat. Nos 5,304,004 or 4,749,281), barometer movement, anemometer movement, or any other conventional instrument movement. The number of shafts and hands that will be provided will depend upon what is necessary in order to provide appropriate indications based upon the movement involved, and the movement may be a dual function movement (such as a combined barometer and thermometer movement with different shafts and different hands associated with the shafts).

Typically instrument indicia is provided on the instrument face upper surface, such as hour numbers, temperature numbers, pressure numbers, or the like. Also preferably word indicia is also provided on the instrument face upper surface, typically associated with the objects disposed within the interior volume. Indicia may, in addition or alternatively, be provided on the top of the cover.

The means defining the passageway may comprise a wide variety of different components. For example a conventional hollow externally threaded brass tube typically utilized with clock movement may comprise substantially the only, or the primary, element defining the passageway, along with the conventional nuts associated therewith. Or the means defining a passageway may comprise a substantially tubular bushing integral with the face, base, or cover, or distinct from the face, base, or cover and separately inserted in the interior volume. Such a bushing may also be utilized with a threaded brass tube, and the bushing may have any cross-sectional configuration such as polygonal, circular, oval, or the like.

The assembly may also include an instrument lens mounted by the casing and disposed on the opposite side of the instrument hand(s) from the cover, the lens also substantially parallel to the cover, and provided for the purpose of protecting the instrument hand(s). The cover and the lens are both preferably mounted by the upstanding portion of the casing, and the casing may be annular, with grooves therein for mounting the cover and/or lens. The casing may be two piece and connected together once the cover and/or lens are properly positioned, or one piece with sufficient flexibility or deformability of the cover, lens, or casing to allow the cover and/or lens to be snapped into place, or the cover and/or lens may be screwed or adhesively secured to a mounting ledge of the base.

It is the primary object of the present invention to provide a measuring instrument assembly of unique construction, allowing discrete physical objects to be associated therewith for enhancing the aesthetics and/or functionality of the measuring instrument. This and other objects of the invention will become clear from an inspection of the detailed description of the invention and from the appended claims.

BRIEF DESCRIPTION OF THE DRAWINGS

FIG. 3 is an exploded perspective view of passageway defining elements associated with the instrument of FIGS. 1 and 2;

FIG. 4 is a perspective exploded view showing an exemplary measuring instrument movement, shafts, and hands such as utilized with the assembly of FIGS. 1 and 2; and FIG. 5 is a partial side view, primarily in cross-section but partly in elevation, of a modified form of the measuring instrument assembly according to the present invention.

DETAILED DESCRIPTION OF THE DRAWINGS

Figure 1:
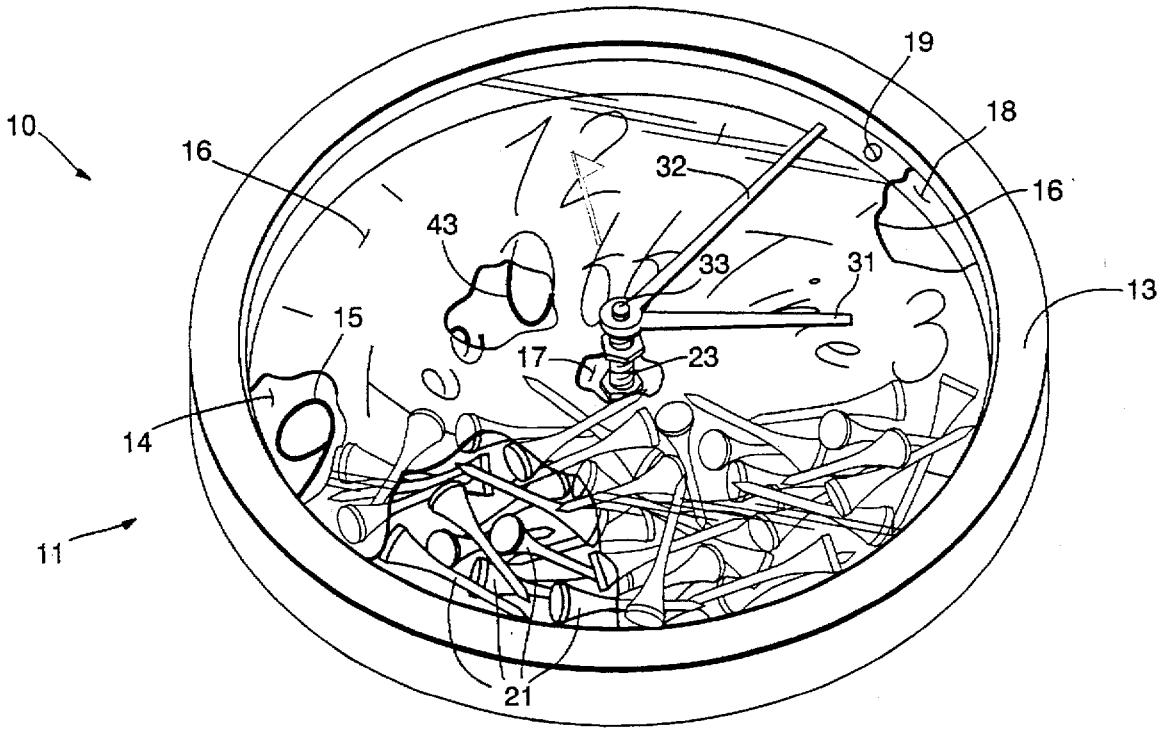
FIG. 1 is a front perspective view, with portions of the cover cut away for clarity of illustration, of an exemplary measuring instrument according to the present invention.

An exemplary measuring instrument assembly according to the present invention is shown generally by reference numeral 10 in FIG. 1. The particular measuring instrument illustrated in FIGS. 1 and 4 comprises a clock, however it is to be understood that other measuring instruments may as well be constructed according to the present invention including thermometers, barometers, anemometers, and like conventional measuring instruments.

The instrument assembly 10 comprises a casing, shown generally by reference numeral 11 in FIG. 1, and including a base 12 (see FIG. 2) and an upstanding perimeter portion 13 (see FIG. 1). The upstanding perimeter portion 13 may be—as illustrated in FIG. 1—substantially annular, although depending upon the instrument or the aesthetics or functionality required or desired may have different configurations including a quadrate shape in plan, or various other polygonal or distinctive configurations (e.g. the shape of a basketball backboard, soccer goal, or the like, such as in U.S. Design Pat. Nos. 354,231 or 288,412).

The instrument assembly 10 also includes an instrument face 14 mounted by the base 12 and having an upper surface facing away from the base 12. Preferably instrument indicia is provided on the face 14 upper surface, such as the clock indicia 15 illustrated in FIG. 1. The indicia 15 is typically printed on the face 14 during manufacture of the face 14.

The assembly 10 also comprises a substantially transparent cover 16 which is substantially parallel to the face 14 and supported by the casing 11, the cover 16 spaced from the face 14 to define, with the casing perimeter portion 13, a substantially closed (so that it can retain objects therein, although gas may flow in and out of it unless there is a need for a hermetic seal) interior volume, shown schematically by reference numeral 17 in FIG. 1. Preferably the transparent cover 16, which may be of glass, clear plastic, such as an acrylic, or the like, is mounted by the casing upstanding portion 13 either supported within a groove thereof, or releasably connected to a ledge 18 thereof, such as by one or more screws or like removable fasteners 19. The casing 11 may have a multi-part construction, or the base 12 and the upstanding perimeter portion 13 may be integral, e.g. molded integrally from plastic.

Disposed within the interior volume 17 is at least one discrete object, such as the plurality of golf tees 21 illustrated in FIG. 1. Preferably a plurality of the objects 21 are provided, and they are loosely disposed within the interior volume 17 so that they can move with respect to each other and with respect to the face 14. Also it is possible to remove the transparent cover 16, such as by removing the one or more screws 19, and the instrument hands as will be hereinafter described, to gain access to the objects 21 either for utilization thereof, or to supplement or replace them. While golf tees 21 are illustrated in FIG. 1 it is to be understood that any discrete objects may be provided within the interior volume 17 including, but not limited to, miniature athletic balls or other athletic equipment, puzzle pieces, dice, poker chips, grids or dividers (which could contain different elements, such as pellets, marbles, herbs, spices, etc.), gears, fasteners, paint brushes, individual elements containing photographs or portions of photographs, miniature motor vehicles, miniature bottles or simulations of bottles, or virtually any other object, or combination of different objects, that might have an aesthetic or "statement"relationship to the user or expected viewer of the instrument 10.

The assembly 10 also comprises means defining a passageway through the interior volume 17 for an instrument shaft extending from the base 12 substantially perpendicular to the face 14 through the cover 16 and spaced from the upstanding perimeter portion 13 of the casing 11 (e.g. preferably substantially centrally located with respect to the cover 16). The means defining the passageway may comprise any known physical elements which are capable of spanning the volume between the face 14 and the cover 16 at the instrument shaft and which merely allow for the shaft to pass through the interior volume 17, protect the shaft, support the cover 16 with respect to the face 14 so that there is no significant deflection of the cover 16, and/or guide the movement of or space the objects 21. For example with respect to FIGS. 1 and 3, the means defining the passageway may comprise a tubular bushing 23, of plastic, metal, or other suitable material, which has a hollow interior, and is aligned with openings (not seen in FIG. 1) in the face 14 and the cover 16 for allowing the passage of the shaft therethrough. The bushing 23 may be—as illustrated in FIG. 3—distinct from the face 14 and the base 12 and the cover 16, or it may be integral with the face 14, base 12, or cover 16.

The passageway defining means instead of, or in addition to, the bushing 23 may comprise a conventional hollow, externally threaded, metal (e.g. brass) tube or screw 24, having nuts 25, 26 associated therewith, which is typically used with a clock movement. The nuts 25, 26 have internal threading corresponding to the external threading on the tube 24.

Figure 2:
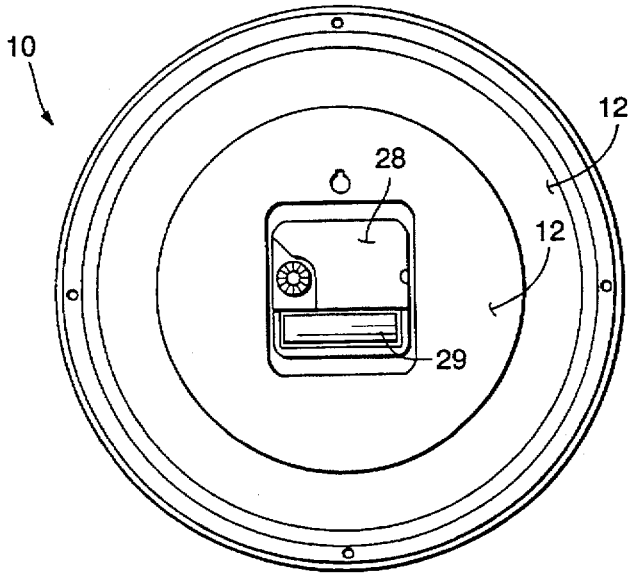
FIG. 2 is a rear view of the measuring instrument of FIG. 1.

The measuring instrument 10 also preferably comprises a measuring instrument movement 28 (see FIGS. 2 and 4) which preferably is a conventional off the shelf component. For example if a clock movement, the movement 28 may be a purchased item from SEIKO, or TAKANE, typically powered by a single battery such as the AA battery 29 illustrated in FIG. 2. If a thermometer movement it may be such as shown in U.S. Pat. Nos. 5,304,004 or 4,749,281. The movement 28 may be mounted snugly within the base 12 within a cavity particularly designed to receive it, as seen in FIG. 2.

An instrument shaft—such as the shaft 30 in FIG. 4 (and more than one instrument shaft may be provided, which would be the case with a clock, or a dual purpose (e.g. thermometer barometer) instrument) extends from the instrument movement 28 through the passageway (e.g. the hollow interiors of one or both of the bushing 23 and tube 24) to a position above the cover 16 (on the opposite side of the cover 16 from the face 14), such as seen in FIG. 1, and at least one instrument hand is connected to the at least one shaft 30. For example as seen in FIG. 4, the hour hand 31 and minute hand 32 are connected to the concentric shafts 30, 30', respectively extending from movement 28. The hands 31,32 are on the opposite side of the cover 16 from the face 14. As is conventional a cap 33 or the like is provided at the free end of the shaft 30 to ensure that the hands 31, 32 are held in place.

The movement 28 and shaft 30 may be entirely conventional, it being possible to purchase movements 28 with shafts 30 of varying length. In the preferred embodiment the length of the shafts 30, 30' from the movement 28 to the free end thereof is typically between about 7/8–1 1/4 inches, although other lengths may be provided depending upon the desired height of the interior volume 17.

FIG. 5 illustrates an instrument assembly 110 according to the present invention which is otherwise substantially identical to the assembly 10 except that it also includes a lens (and associated supports) for covering the instrument hands 31, 32 to protect them. Thus in FIG. 5 all of the components that are identical to those in FIGS. 1 through 4 are shown by the same reference numeral, whereas components that are functionally comparable but different in configuration are shown by the same reference numeral only preceded by a "1".

The major differences between the instrument assembly 110 and the instrument assembly 10 are that the casing perimeter portion 113 also mounts an instrument lens 35 which is also substantially transparent (e.g. clear plastic or glass) and is substantially parallel to and spaced from the cover 16, as illustrated in FIG. 5. The lens 35 allows the hands 31, 32 to be viewed without distortion, as well as the objects 21 within the interior volume 17, yet protects the hands 31, 32. In the embodiment illustrated in FIG. 5 the lens 35 is shown mounted within an annular groove 36 in the casing upstanding perimeter portion 113, although it may merely be connected by fasteners to a shoulder or ledge 37 by removable fasteners, such as the fasteners 19 that connect the cover 16 to the shoulder or ledge 18 in the FIG. 1 embodiment. The casing perimeter portion 113 may be made in two pieces to fit around the lens 35 and/or cover 16, or there may be sufficient flexibility or deformability of the perimeter portion 113 and/or lens 35 and cover 16 to allow the lens 35 and cover 16 to be snapped into place in supporting grooves, such as the groove 36 in FIG. 5.

Another feature of the assembly 110 is that the bushing 123 is integral with the cover 16, although it may be alternatively integral with the casing 12, or face 14. FIG. 5 also shows the openings 40 and 41 in the face 14 and cover 16, respectively, which define part of the passageway for receipt of the shaft 30 or shafts 30, 30'. In the assembly 110 the nut 25 engages the upper surface of the face 14 while screw threaded on the tube 24, while the nut 26 is threaded on the tube 24 and engages the surface of the cover 16 opposite the interior volume 17. In the embodiment illustrated in FIG. 5 the bushing 123 engages the nut 25 to provide a positive support for, and prevent significant deflection of, the cover 16. The bushing 123 may alternatively engage the face 14, or a portion of the base 12 (or even the movement 28) directly.

A wide variety of other modifications may be provided according to the invention. For example as seen in FIG. 1, word indicia 43 may be printed or otherwise provided on the upper surface of the face 14, the word or indicia 43 typically associated with the objects 21 (for example "Tee Time" when golf tees 21 are provided). Instrument or word indicia (not shown) may alternatively, or in addition, be imaged or painted on cover 16, or even lens 35.

It will thus be seen that according to the present invention a highly desirable and unique measuring instrument assembly is provided, allowing the utilization of discrete objects mounted thereby which objects do not adversely affect the operation of the instrument. While the invention has been herein shown and described in what is presently conceived to be the most practical and preferred embodiment thereof it will be apparent to those of ordinary skill in the art that many modifications may be made thereof within the scope of the invention, which scope is to be accorded the broadest interpretation of the appended claims so as to encompass all equivalents structures and devices.

What is claimed is:

1. A measuring instrument assembly comprising:

a stationary casing including a base and an upstanding perimeter portion;

an instrument face mounted by said base and having an upper surface facing away from said base;

a substantially transparent cover substantially parallel to said instrument face and supported by said casing, said cover spaced from said face to define, with said casing upstanding perimeter portion, a substantially closed interior volume and wherein said cover is mounted by said upstanding portion of said casing;

at least one discrete object disposed within said interior volume;

a lens covering said instrument face on the opposite side of said face from said base, and having a peripheral portion;

said lens peripheral portion received within an annular groove in said casing upstanding portion; and means defining a passageway through said interior volume for an instrument shaft extending from said base substantially perpendicular to said face, through said cover, and spaced from said upstanding perimeter portion of said casing clock movement mounted by said base, at least two clock shafts extending from said clock movement through said passageway, and at least an hour hand and minute hand connected to said shafts on the opposite side of said cover from said face wherein said means defining said passageway includes an externally threaded metal tube engaging a first nut within said interior volume adjacent said base, and engaging a second nut at said cover on the opposite side of said cover from said interior volume; and an element engaging said cover within said interior volume to prevent significant deflection of said cover toward the interior of said volume at said passageway.

2. A measuring instrument assembly as recited in claim 1 further comprising: a measuring instrument movement mounted by said base; at least one instrument shaft extending from said instrument movement through said passageway; and at least one instrument hand connected to said at least one shaft on the opposite side of said cover from said face; said at least one discrete object not adversely affecting said measuring instrument movement.

3. A measuring instrument assembly as recited in claim 2 further comprising instrument indicia on said instrument face upper surface.

4. A measuring instrument assembly as recited in claim 3 wherein said instrument face comprises a clock face, said indicia comprises clock indicia, said movement comprises a clock movement, and said at least one hand includes at least an hour hand and a minute hand.

5. A measuring instrument assembly as recited in claim 1 further comprising word indicia, associated with the objects within said interior volume, on said instrument face upper surface.

6. A measuring instrument assembly as recited in claim 1 wherein said upstanding portion of said casing comprises an annular element integral with said base, said annular groove formed in said annular element.

7. A measuring instrument assembly as recited in claim 1 wherein said at least one discrete object comprises a plurality of discrete objects which are loosely disposed within said interior volume so that they can move within said interior volume with respect to said face and with respect to each other.

8. A measuring instrument assembly as recited in claim 7 wherein said plurality of discrete objects comprises a plurality of golf tees.

9. A measuring instrument assembly as recited in claim 8 further comprising word indicia, associated with within said golf tees within said interior volume, on said instrument face upper surface.

10. A measuring instrument assembly comprising:

a stationary casing including a base and an upstanding perimeter portion;

an instrument face mounted by said base and having an upper surface facing away from said base;

a substantially transparent cover substantially parallel to said instrument face and supported by said casing, said cover spaced from said face to define, with said casing upstanding perimeter portion, a substantially closed interior volume;

at least one discrete object disposed within said interior volume;

means defining a passageway through said interior volume for an instrument shaft extending from said base substantially perpendicular to said face, through said cover, and spaced from said upstanding perimeter portion of said casing;

a clock movement mounted by said base, at least two clock shafts extending from said clock movement through said passageway, and at least an hour hand and minute hand connected to said shafts on the opposite side of said cover from said face; and wherein said means defining said passageway includes an externally threaded metal tube engaging a first nut within said interior volume adjacent said base, and engaging a second nut at said cover on the opposite side of said cover from said interior volume; and an element engaging said cover within said interior volume to prevent significant deflection of said cover toward the interior of said volume at said passageway.

11. A measuring instrument assembly as recited in claim 10 further comprising an instrument lens mounted by said casing and disposed on the opposite side of said at least one instrument hand from said cover, said lens substantially parallel to said cover.

12. A measuring instrument assembly as recited in claim 11 wherein said cover and said lens are mounted by said upstanding portion of said casing.

* * * * *